United States Patent [19]

Gallucci et al.

[11] 3,955,804

[45] May 11, 1976

[54] ADJUSTABLE APPARATUS FOR CUTTING A CONTINUOUSLY-FORMED CASTING INTO SHORT-LENGTH SEGMENTS

[75] Inventors: Francis Gallucci, North Huntingdon Township, Westmoreland County; Frank Slamar, Monroeville Borough, both of Pa.

[73] Assignee: United States Steel Corporation, Pittsburgh, Pa.

[22] Filed: Dec. 23, 1971

[21] Appl. No.: 211,487

[52] U.S. Cl. ..... 266/50; 164/263; 266/67

[51] Int. Cl.[2] ..... B23K 7/10

[58] Field of Search ..... 164/263, 70; 266/23 K, 266/23 M; 148/9, 9.6; 83/303, 513, 515, 516; 72/185; 213/75 R; 280/81 R

[56] References Cited

UNITED STATES PATENTS

| | | | |
|---|---|---|---|
| 808,261 | 12/1905 | Strickland | 280/81 R |
| 2,317,239 | 4/1943 | Yoch | 148/9.6 X |
| 2,517,622 | 8/1950 | Babcock | 148/9 |
| 3,462,134 | 8/1969 | Michelson | 266/23 K |

FOREIGN PATENTS OR APPLICATIONS

| | | | |
|---|---|---|---|
| 3,692 | 10/1968 | Japan | 164/263 |

*Primary Examiner*—Robert D. Baldwin
*Attorney, Agent, or Firm*—Walter P. Wood

[57] ABSTRACT

A method and apparatus for cutting short-length segments from a continuously-formed casting as it travels from the casting apparatus. The apparatus embodies conventional torches and carriages which are coupled together to perform two or more cutting operations simultaneously. The invention has particular utility for cutting segments which are too short to permit a single carriage to cut the casting and return to its starting position in time for the next cut.

6 Claims, 2 Drawing Figures

Figure 1:
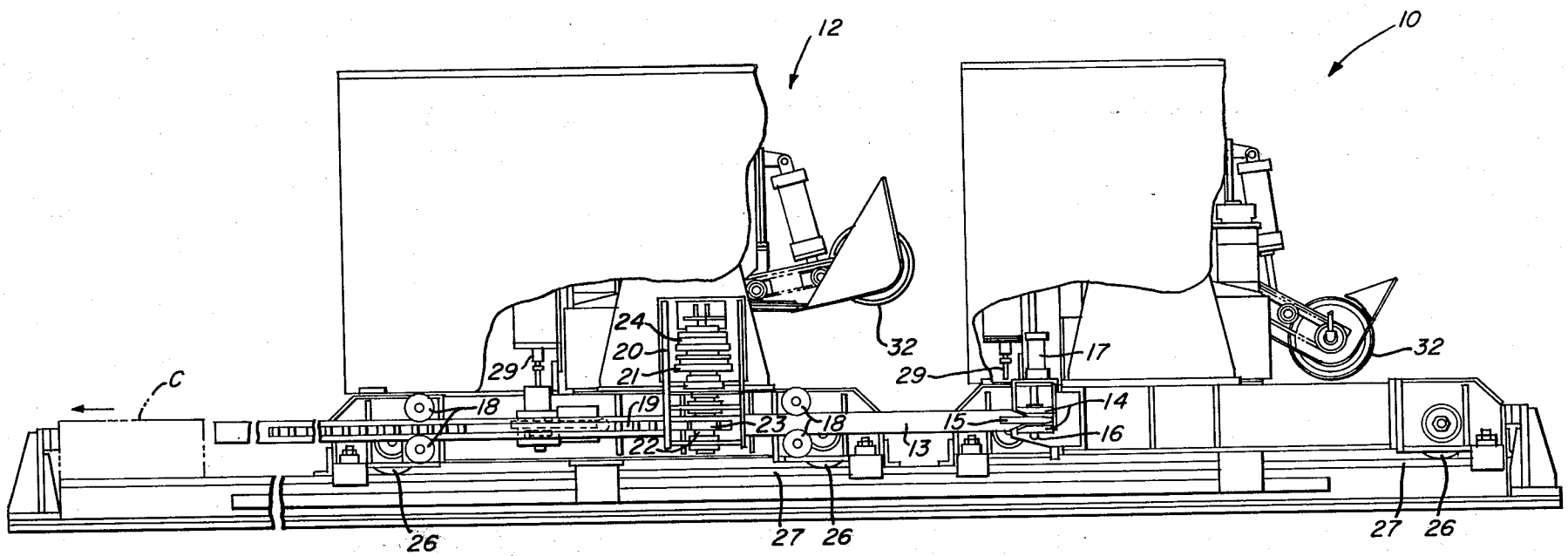

ADJUSTABLE APPARATUS FOR CUTTING A CONTINUOUSLY-FORMED CASTING INTO SHORT-LENGTH SEGMENTS

This invention relates to an improved apparatus for cutting a continuously-formed casting into short-length segments.

In a conventional continuous-casting operation, a casting of indefinite length emerges from the casting apparatus traveling along a conveyor in a horizontal direction. As a final step in the operation, the casting is cut into shorter segments of measured length for subsequent handling and processing. Common practice is to cut the casting with torches mounted on a carriage, which is automatically clamped to the casting and travels therewith while the torches operate. After each cutting operation, the carriage returns to its starting position, where it remains until the desired measured length of casting again passes. The operation then is repeated. Reference can be made to Greenberger U.S. Pat. No. 3,443,805 for an exemplary showing. It is known also to employ a retractable measuring roller which rides on the casting surface for determining when the desired length of casting has passed the carriage. The measuring roller is connected in a circuit which automatically starts each cutting operation at the proper moment. Reference can be made to Adams U.S. Pat. No. 3,358,743 for an exemplary showing.

The foregoing arrangements operate satisfactorily if the segments to be cut from the casting are sufficiently long that the torches can complete their operation and the carriage can return before another operation must begin, but sometimes shorter segments are desired. For example, one mill for rolling steel plate utilizes as starting material slabs which are 9 by 76 inches in cross section, but only about 6 to 10 feet in length. When the casting is traveling at its normal speed of about 75 inches per minute, the equipment does not operate rapidly enough to cut segments of such short length.

An object of our invention is to provide an improved apparatus for cutting a continuously formed casting into segments which are shorter that the minimum obtained with conventional equipment.

A further object is to provide an improved apparatus of the foregoing type which utilizes two or more carriages and corresponding torches operating simultaneously, whereby more than one segment can be cut from the casting during each operation.

Figure 2:
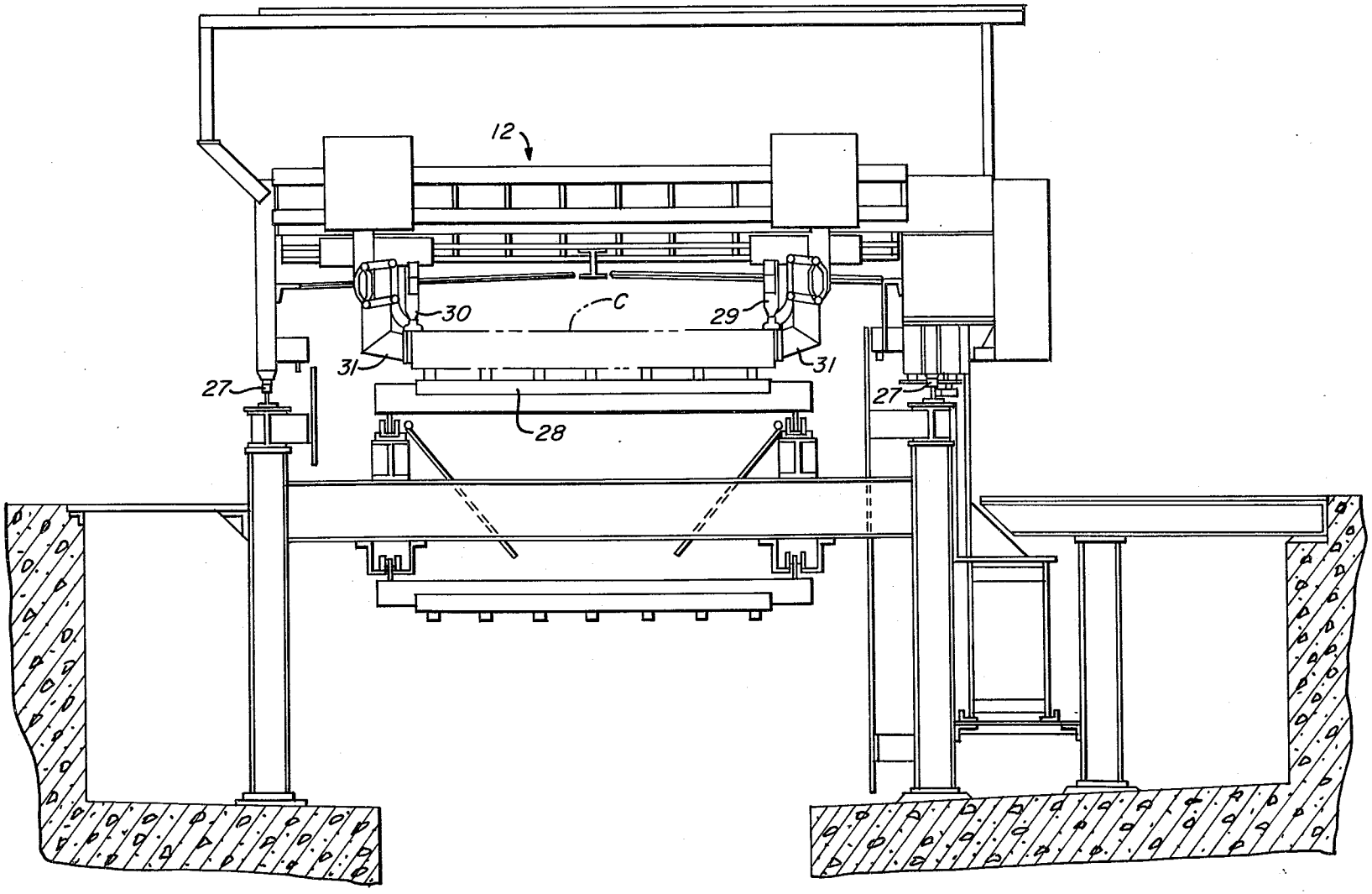

In the drawing:

FIG. 1 is a side elevational view of an apparatus constructed in accordance with our invention; and FIG. 2 is an end elevation view from the left as viewed in FIG. 1.

Our apparatus comprises two spaced-apart carriages 10 and 12, which we couple together end-to-end. The coupling means includes an elongated bar 13, one end of which we removably attach to the side of carriage 10. The attaching means illustrated includes a pair of vertically spaced lugs 14 projecting from the side of the carriage, a tongue 15 extending from the end of bar 13 and received between the lugs, and a vertically movable lock pin 16 extending through aligned holes in the lugs and tongue. An actuating cylinder 17 is fixed to the side of carriage 10 for lowering or raising the lock pin to connect or disconnect the bar. A plurality of pairs of vertically spaced guide rollers 18 are journaled to the side face of carriage 12 and receive bar 13 between them. The outer face of bar 13 carries a rack 19. The side face of carriage 12 carries a frame 20 in which we mount a motor 21. The motor has a shaft 22 which extends vertically downward therefrom and carries a pinion 23. The latter engages the rack 19, whereby rotation of the pinion adjusts the spacing between the two carriages. Preferably the motor has an automatic brake 24 of conventional construction for stopping the pinion when the motor is deenergized.

Apart from the coupling means, the two carriages 10 and 12 can be of similar conventional construction. The carriages have wheels 26 which ride on rails 27 extending in the direction of travel of a casting C. The casting is carried on a conveyor 28 (FIG. 2). Each carriage supports a pair of cutting torches 29 and 30 which are arranged to travel transversely of the slab from opposite edges toward the middle as they make their cut. Each carriage has clamps 31 for clamping it to the casting during the cutting operation, although clamps on only one carriage would suffice. Each carriage also carries a respective retractable measuring roller 32, although in normal operation, as hereinafter explained, we use only the measuring roller on carriage 10. Since the carriages and parts carried thereby per se are of conventional construction and operation, no detailed description is deemed necessary.

Initially we operate motor 21 to adjust the spacing between carriages 10 and 12 so that the distance between the torches 30 on carriage 10 and the torches on carriage 12 equals the length of segment to be cut from the casting C. We adjust the circuit controlled by the measuring roller 32 on carriage 10 to start operation of the torches 30 and clamps 31 of both carriages when a length of casting equal to the sum of the lengths of two segments length has been measured. Usually the two segments are of equal length, and the sum of course equals twice this length. Nevertheless it is possible to cut segments of unequal length in which event we adjust the carriage spacing so that the distance between torches equals the length of either the longer or the shorter segment. The casting C travels continuously from right to left, as viewed in FIG. 1. Initially carriage 10 is in its starting position at the extreme right, and the measuring roller 32 is in its lowered position in which it rides on the casting surface.

As soon as the measuring roller 32 measures a length of casting equal to the sum of two segment lengths, clamps 31 engage the casting, the measuring roller 32 retracts, and the torches of both carriages commence to travel transversely of the casting and cut two segments therefrom. On completion of the cutting operation, the torches retract, the measuring roller is lowered into engagement with the casting surface, and the carriages retract to their starting position. The operation is repeated as soon as the measuring roller again measures a length of two segments.

From the foregoing description, it is seen that our invention affords a simple method and apparatus for cutting more than one segment from a continuously-formed casting during each operation. Although we have shown two carriages, it is apparent the number can be extended if desired. The coupling means enables the spacing between carriages to be adjusted for any length segment within a reasonably wide range, or for the carriages to be uncoupled for cutting segments singly. By cutting two or more segments at one, we are able to cut relatively short segments while the casting machine operates at its normal rate.

We claim:

1. Apparatus for simultaneously cutting a plurality of segments of a measured but adjustable length from a continuously-formed casting as it travels, said apparatus comprising a plurality of carriages, means coupling said carriages together in spaced-apart relation, cutting means on each of said carriages and being spaced apart a distance equal to the length of one segment, said coupling means being adjustable to vary the spacing between said cutting means and thereby adjust the segment length, releasable clamping means carried by at least one of said carriages for engaging the casting, whereby both carriages travel with the casting when the clamping means is engaged therewith, and measuring means carried by at least one of said carriages for measuring a length of casting equal to the combined length of a corresponding plurality of segments, whereby said apparatus cuts a plurality of segments from the casting with each operation.

2. Apparatus as defined in claim 1 in which there are two carriages and said measuring means measures a length of casting equal to two segments.

3. Apparatus as defined in claim 1 in which said cutting means are in the form of torches which travel transversely of the casting as they cut.

4. Apparatus as defined in claim 2 in which said coupling means includes a bar fixed to one of said carriages and means on the other carriage adjustably connected with said bar.

5. Apparatus as defined in claim 2 in which the segment length is too short to permit a single cutting means to cut a segment and return in time to cut another segment with the casting traveling at its normal speed.

6. Apparatus as defined in claim 2 in which said coupling means includes a bar attached to the side of one of said carriages, a rack on said bar, a pinion supported on the other carriage and engaging said rack, and guide rollers on the latter carriage engaging said bar, whereby rotation of said pinion adjusts the carriage spacing.

* * * * *